United States Patent [19]

Booher

[11] 4,417,670

[45] Nov. 29, 1983

[54] DEVICE FOR DISPENSING TISSUE PAPER AND SHEET MATERIAL

[76] Inventor: Homer L. Booher, Sarasota, Fla.

[21] Appl. No.: 224,653

[22] Filed: Jan. 12, 1981

[51] Int. Cl.[3] ..... B65G 59/02

[52] U.S. Cl. ..... 221/210; 16/226

[58] Field of Search ..... 221/210; 271/33; 16/188, 189, 305, 72, 76, 226

[56] References Cited

U.S. PATENT DOCUMENTS

| | | | |
|---|---|---|---|
| 1,060,678 | 5/1913 | Greenidge | 16/226 |
| 1,730,126 | 10/1929 | Dailey . | |
| 2,032,150 | 2/1936 | Richardson . | |
| 2,071,981 | 2/1937 | Landsiedel . | |
| 2,269,525 | 1/1942 | Fleischer . | |
| 2,341,794 | 2/1944 | Kliwer . | |
| 2,885,112 | 5/1959 | Willat . | |
| 3,094,323 | 6/1963 | Catania . | |
| 3,204,817 | 9/1965 | Kostering . | |
| 3,234,903 | 2/1966 | Vara, Sr. | 16/226 X |
| 3,248,006 | 4/1966 | Lowery et al. . | |

*Primary Examiner*—Stanley H. Tollberg
*Attorney, Agent, or Firm*—Benjamin P. Reese, II

[57] ABSTRACT

A device for dispensing tissue paper and similar sheet material, such as hair end-wrap papers used in the beauty and cosmetology profession. A pick-up assembly is mounted on an essentially rectangular container for a stack of tissue paper or similar sheet material. The pick-up assembly is comprised of a pick-up head having an adhesive secured thereto for contacting the top sheet of the stack, a rigid shaft connected to the pick-up head, a coil spring having one of its ends fitted over the rigid shaft and the other of its ends rigidly connected at a positive angle on a top center location of one of the ends of the container, and a spring cover. When the user of the device presses the pick-up head downward, the coil spring bends until the adhesive on the pick-up head contacts the top sheet of the shaft and separates and lifts the top sheet from the stack as the coil spring straightens to return the pick-up head to its original position.

3 Claims, 7 Drawing Figures

DEVICE FOR DISPENSING TISSUE PAPER AND SHEET MATERIAL

BACKGROUND OF THE INVENTION

This invention relates to a device for dispensing tissue paper and similar sheet material, such as hair end-wrap papers used in the beauty and cosmetology profession.

The difficulty which occurs when one desires to remove a single sheet of tissue paper from the top of a stack of such paper is well known to hair stylists and other persons in the beauty and cosmetology profession. While an occasional person will have what appears to be a natural ability to accomplish that task, most people find the task to be both frustrating and time consuming. Often, a person desiring to remove a single sheet of tissue paper from the top of a stack of such papers will wet one or more of his or her fingers to facilitate accomplishment of that task. Unfortunately, that practice wets the tissue paper and is unsightly to many patrons of beauty and cosmetology salons.

The prior art provides various devices for dispensing single sheets of tissue paper and similar sheet material. Many of the prior art devices are neither intended nor suitable for use in the beauty and cosmetology profession. Several prior art devices which are intended for use in that profession are disclosed in U.S. Pat. No. 2,885,112, issued to Willat, for a "Sheet Paper Dispensing Device"; U.S. Pat. No. 3,094,323, issued to Catania, for "End Papers for Hair Waving and Dispenser Thereof"; U.S. Pat. No. 3,204,817, issued to Kostering, for a "Device for Dispensing End Papers for Hair Rollers"; and U.S. Pat. No. 3,248,006, issued to Lowery et al., for a "Sheet Tissue Paper Dispenser".

The various prior art devices which are disclosed in U.S. Pat. Nos. 2,885,112, 3,094,323 and 3,204,817 have not achieved significant popularity with the members of the beauty and cosmetology profession. It is believed that this failure to achieve popularity is the result of various operational disadvantages which are inherent in those devices. While the prior art device which is disclosed in U.S. Pat. No. 3,248,006 is free of many of those disadvantages, it is believed that it has several disadvantages which have limited its use by members of the beauty and cosmetology profession.

That device consists essentially of a rectangular container having a bottom wall and side walls with three connected corners and one open corner, an elongated coil spring with one end secured to the top of one connected corner of the container and the other end extending diagonally across the container to its open corner, and a spherical pick-up head mounted on the free end of the coil spring. A non-drying, pressure sensitive tacky adhesive is provided on the lower portion of the spherical pick-up head for contacting the sheet of tissue paper to be removed from the top of a stack of such paper in the rectangular container. The elongated coil spring and spherical pick-up head are positioned generally in the horizontal plane of the open top of the rectangular container.

With the coil spring and pick-up head positioned in the manner described, it is not possible to efficiently dispense single sheets of tissue paper with the device if the rectangular container is filled with tissue paper. In such case, the vertical space between the bottom of the pick-up head and the top sheet of the stack of tissue paper is not sufficient for convenient grasping of the dispensed sheet by the user of the device. Even when a smaller stack of tissue paper is placed in its container, the device disclosed in U.S. Pat. No. 3,248,006 has several major operational disadvantages. First, since its coil spring and pick-up head are positioned generally in a horizontal plane, the user of the device must grasp the dispensed tissue paper through the open corner of the rectangular container. Next, since its coil spring is not restrained along its length and its pick-up head has a spherical form, the user of the device must apply force to the pick-up head at essentially a 90° angle to the horizontal plane containing the top sheet in the stack of tissue paper to assure that the adhesive on the lower portion of the pick-up head actually contacts the tissue paper.

The undamped oscillations and vibrations of the unrestrained, elongated coil spring of that device can cause the dispensed sheet of tissue paper to fall from the pick-up head. And, of course, this operational disadvantage becomes more serious after the device has been used for an extended period of time. Finally, with that device, the elongated coil spring is exposed to water and various chemical solutions which are routinely used in beauty and cosmetology salons. Even if stainless steel or another suitable corrosion resistant material is used for manufacture of the coil spring, unsightly and unsanitary crud and other deposits often accumulate between the coils of the spring. And, of course, it is difficult, if not impossible, to remove such deposits from between the coils.

It is desirable to have a device for dispensing tissue paper and similar sheet material which does not have the disadvantages inherent in the device disclosed in U.S. Pat. No. 3,248,006 and other prior art devices. Such a device would be particularly useful to persons in the beauty and cosmetology profession.

OBJECTS OF THE INVENTION

The primary object of this invention is to provide a device for dispensing tissue paper and similar sheet material which does not have the various disadvantages which are inherent in prior art devices intended for that purpose. A further object of this invention is to provide such a device which efficiently dispenses single sheets of tissue paper regardless of the height of the stack of tissue paper contained in the device. Another object of this invention is to provide such a device which enables its user to grasp the dispensed tissue paper when reaching from any of numerous angles and from any of numerous directions. Yet another object of this invention is to provide such a device which is capable of dispensing single sheets of tissue paper rapidly without excessive oscillations and vibrations which distract the user of the device and cause the dispensed tissue paper to fall from the pick-up head. A further object of this invention is to provide such a device having an enclosed coil spring which minimizes accumulations of unsightly and unsanitary crud and other deposits on and between the coils of the spring. Yet another object of this invention is to provide such a device which is capable of dispensing two sheets of tissue paper simultaneously.

SUMMARY OF THE INVENTION

The present invention provides a device for dispensing tissue paper and similar sheet material which does not have the various disadvantages inherent in prior art devices intended for that purpose. In one embodiment of the present invention, the device dispenses single sheets of tissue paper or other sheet material. Another embodiment provides a device which simultaneously dispenses two sheets of tissue paper or other sheet material.

In its preferred embodiments, the device of the present invention is comprised of an essentially rectangular tissue paper container and a pick-up assembly. The pick-up assembly is comprised of a cylindrical pick-up head, a drip washer, a rigid shaft, a coil spring and a spring cover. A support post is provided at a top center location on one of the interior end walls of the container. The pick-up assembly is mounted on the container by fitting one end of its coil spring over the support post. The rigid shaft is positioned in the interior of the other end of the coil spring and is connected to the side of the cylindrical pick-up head. The drip washer is fitted on the rigid shaft between the pick-up head and the end of the coil spring and the spring cover is fitted over the coil spring. A nondrying, pressure sensitive tacky adhesive is provided on the underside of the pick-up head.

The container of one embodiment has a single compartment for a single stack of tissue paper or other sheet material. In another embodiment, the container is provided with two identical compartments for two stacks of tissue paper or other sheet material. To dispense the top sheet from the stack in the single compartment container or the top sheet from each stack in the double compartment container, the user of the device presses the pick-up head downward until the adhesive contacts the top sheet of the stack or stacks. When the pick-up head is released, it returns to its original position and lifts and separates the top sheet from each such stack. The entire pick-up assembly is positioned at a positive angle to horizontal to provide sufficient space between the pick-up head and the top horizontal plane of the tissue paper container for the user of the device to grasp the lifted and separated sheet or sheets from any of numerous angles and any of numerous directions.

These and many other advantages, features and objects of the present invention will be apparent from the following Brief Description of Drawings, Description of the Preferred Embodiments and claims.

DETAILED DESCRIPTION OF THE PREFERRED EMBODIMENTS

Figure 5:
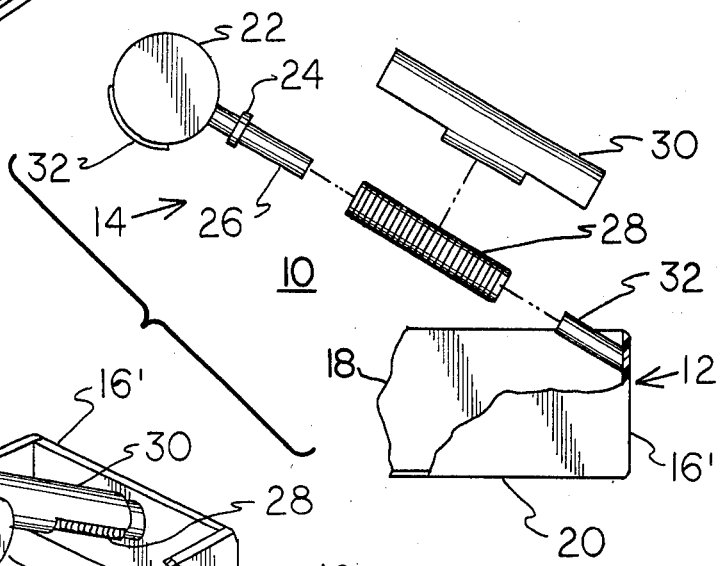
FIG. 5 is an exploded partial side elevational view of the device illustrated in FIG. 1 further illustrating the structural elements which comprise that devise.
Figure 6:
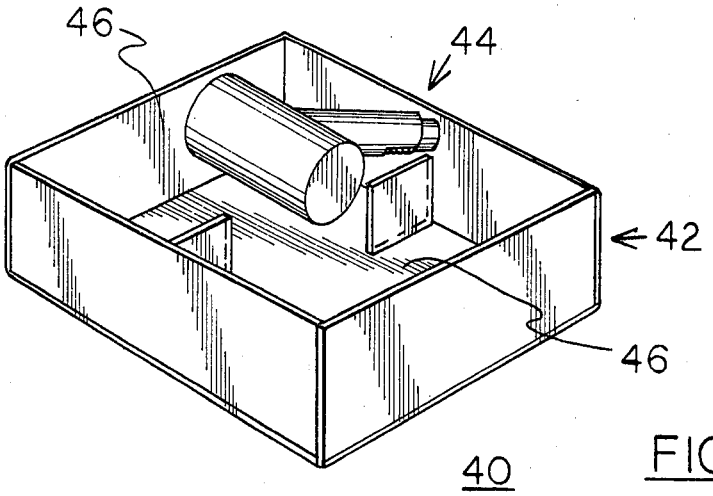
FIG. 6 is a top perspective view of an alternate embodiment of the device of the present invention for dispensing two sheets of tissue paper simultaneously.
Figure 7:
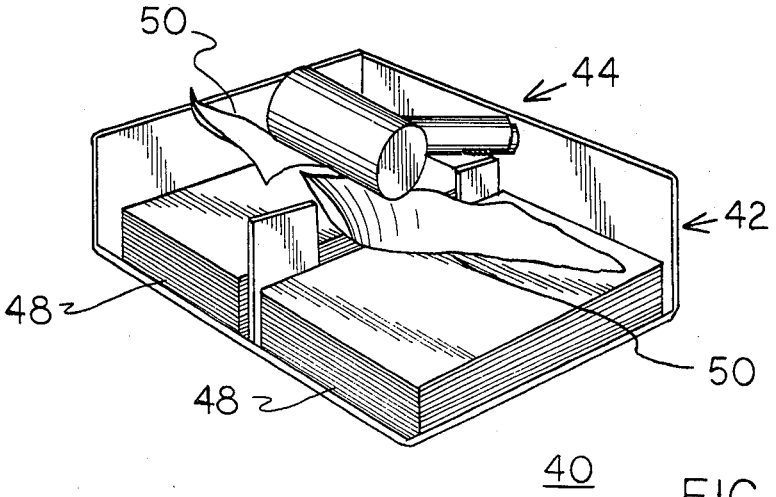
FIG. 7 is a top perspective view similar to FIG. 6 but illustrating two sheets of tissue paper held by the adhesive on the pick-up head after removal from the tops of the two stacks of tissue paper illustrated in both FIG. 6 and FIG. 7.

The preferred embodiments of the device for dispensing tissue paper and sheet material of the present invention are illustrated in FIGS. 1–7. The embodiment which is illustrated in FIGS. 1–5 is capable of dispensing single sheets of tissue paper or other suitable sheet material. An embodiment which is capable of simultaneously dispensing two sheets of tissue paper or other suitable sheet material is illustrated in FIGS. 6 and 7.

Referring to FIGS. 1–5, the device for dispensing single sheets of tissue paper or other sheet material which is illustrated is designated generally by the reference numeral 10. The device 10 is comprised of an essentially rectangular tissue paper container 12 and a pick-up assembly 14. Preferably, the container 12 is cast or molded in the shape which is illustrated from a suitable plastic material. Of course, other materials and methods can be used for fabrication of the container 12 without departing from the spirit and scope of the present invention. For example, the container 12 could be fabricated by cutting five rectangular components, a pair of ends 16, a pair of sides 18 and a bottom 20, from a flat sheet of any suitable rigid material and joining those components by conventional means, such as adhesive bonding.

The pick-up assembly 14 is comprised of a cylindrical pick-up head 22, a drip washer 24, a rigid shaft 26, a coil spring 28 and a spring cover 30. Preferably, the cylindrical pick-up head 22 and the rigid shaft 26 are fabricated from suitable plastic dowels or rods having the desired diameter. For maximum corrosion resistance, it is preferred that the drop washer 24 be fabricated from a suitable plastic or rubber material and the coil spring 28 be fabricated from stainless steel. The spring cover 30 should preferably be fabricated from a suitable semi-rigid plastic or rubber material. The present invention is not limited by the materials and methods used for fabrication of these components, however.

The assembly of the cylindrical pick-up head 22, the drop washer 24, the rigid shaft 26, the coil spring 28 and the spring cover 30 to form the pick-up assembly 14 and the mounting of the assembled pick-up assembly 14 are best illusby the exploded view in FIG. 5. Referring to FIG. 5, a support post 32 is provided in the interior of the tissue paper container 12 at a top center location on one of the ends 16' of the container 12. The support post 32 can be cast or molded as an integral part of the container 12 or fabricated from a suitable dowel or rod and secured to the appropriate location on the end 16' by conventional means, such as adhesive bonding.

The support post 32 is positioned at a suitable angle to the horizontal to assure that the distance between the pick-up head 22 of the pick-up assembly 14 and the top horizontal plane of the tissue paper container 12 is sufficient for conveniently grasping dispensed tissue paper and other sheet material. Preferably, this angle is at least 30° but not more than 45°. One end of the coil spring 28 is fitted over the free end of the support post 32. One end of the rigid shaft 36 is connected to the side of the cylindrical pick-up head 22 by conventional means, such as adhesive bonding in a cylindrical hole in the pick-up head 22, and extends into the interior opening at the free end of the coil spring 28. The drip washer 24 is fitted on the rigid shaft 26 between the pick-up head 22 and the free end of the coil spring 28. Finally, the spring cover 30 is fitted around the coil spring 28.

A nondrying, pressure sensitive tacky adhesive 32 is provided on the underside of the pick-up head 22. Numerous commercially available adhesives are suitable for this purpose. However, a tape material having an adhesive coating on each side is preferred for use as the adhesive 32. Such a tape material can be readily replaced if its effectiveness is reduced following extensive use. Of course, a tape material having an adhesive coating on one side only is equally suitable if appropriate means for securing the tape to the pick-up head 22 with its coated side up are utilized.

Figure 1:
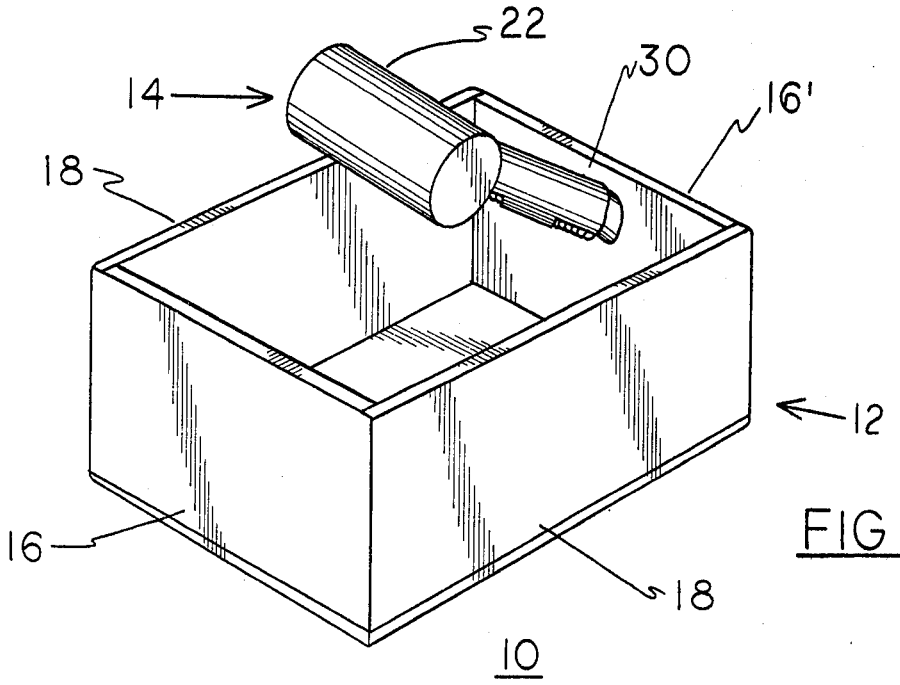
FIG. 1 is a top perspective view of one embodiment of the device of the present invention.
Figure 2:
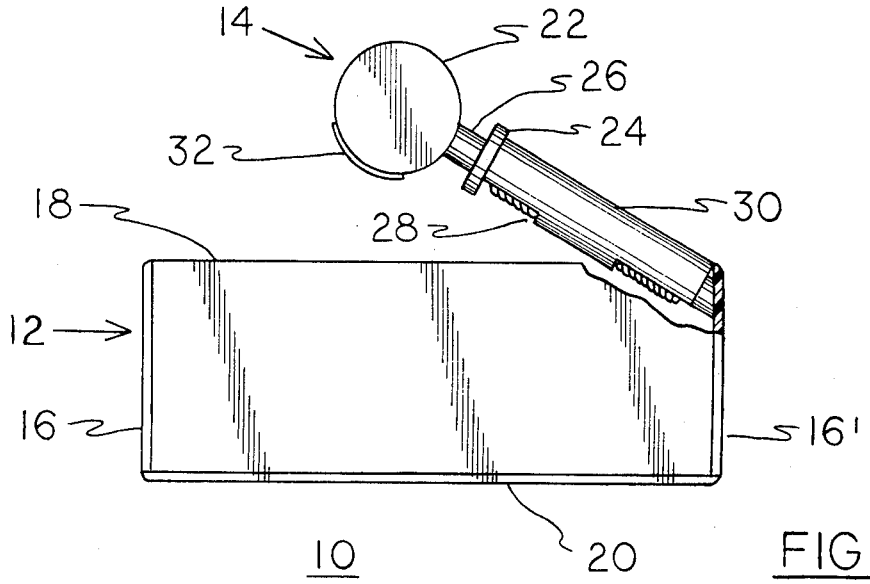
FIG. 2 is a side elevation view of the device illustrated in FIG. 1.
Figure 3:
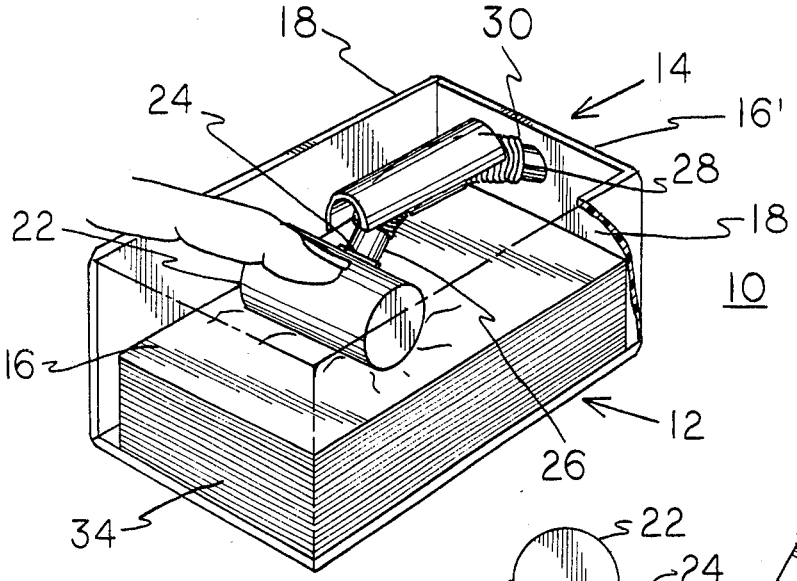
FIG. 3 is a top perspective view similar to FIG. 1 but illustrating a stack of tissue paper in the container and further illustrating the operation of the pick-up head to remove the top sheet from that stack.
Figure 4:
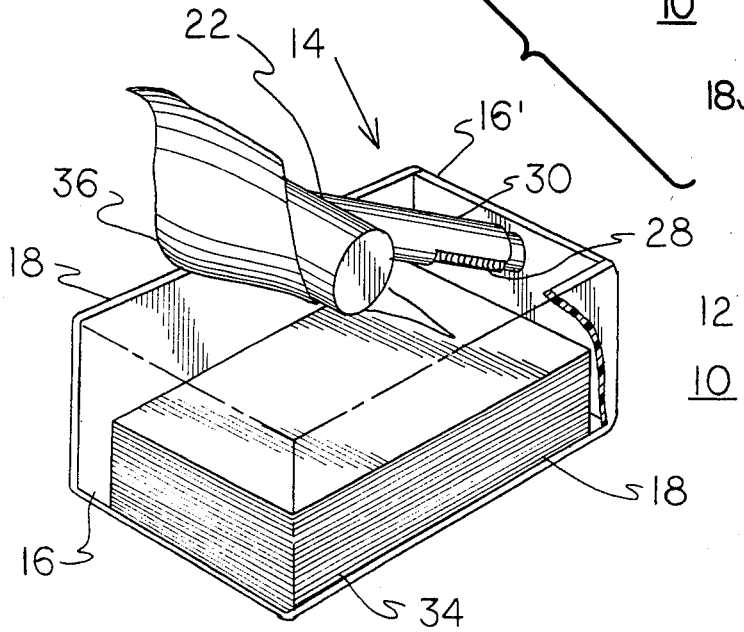
FIG. 4 is a top perspective view similar to FIGS. 1 and 3 but illustrating a single sheet of tissue paper held by the adhesive on the pick-up head after removal from the top of the stack.

Referring to FIGS. 3 and 4, a stack 34 of tissue paper is illustrated in the container 12. To dispense the top sheet 36 from the stack 34, the user of the device 10 presses the pick-up head 22 downward with one or more of his or her fingers. The coil spring 28 bends as the pick-up head 22 is pressed downward until the adhesive 32 on the underside of the pick-up head 22 contacts the top sheet 36. It will be observed in FIG. 3 that the spring cover 30 remains essentially straight as the coil spring 28 is bent downward. When the adhesive 32 contacts the top sheet 36, the pick-up head 22 is released allowing the coil spring 28 to straighten and return the pick-up head 22 to its original position. It will be readily appreciated that the spring cover 30 restrains the coil spring 28 as its straightens, and, thereby, damps any oscillations and vibrations which would otherwise occur.

As illustrated in FIG. 4, the top sheet 36 is lifted and separated from the stack 34. The top sheet 36 is retained by the adhesive 32 on the underside of the pick-up head 22 in a position substantially above the top horizontal plane of the tissue paper container 12. It will be readily appreciated that the user of the device 10 can conveniently grasp the top sheet 36 from any of numerous angles and any of numerous directions. And, of course, the top sheet 36 can easily be removed from the pick-up head 22 with dry fingers.

Referring to FIGS. 6 and 7, the device for simultaneously dispensing two sheets of tissue paper or other sheet material which is illustrated is designated generally by the reference numeral 40. The device 40 is comprised of an essentially rectangular tissue paper container 42 and a pick-up assembly 44. The structure and operation of the pick-up assembly 44 are identical to that of the pick-up assembly 22 illustrated in FIGS. 1–5. In fact, the only difference between the device 40 illustrated in FIGS. 6 and 7 and the device 10 illustrated in FIGS. 1–5 is that the container 42 of the device 40 has two separate compartments 46 for two identical stacks 48 of tissue paper instead of the single compartment of the container 12 provided with the device 10. FIG. 7 illustrates the device 40 with the top sheets 50 of the stacks 48 lifted and separated from the stacks 48.

Many variations in the structural and fabrication details are possible without departing from the scope and spirit of the present invention. For example, the pick-up head 22, drop washer 24 and rigid shaft 26 could be fabricated as a single component by conventional means, e.g. injection molding a suitable plastic material or die casting a suitable aluminum alloy. And, of course, the pick-up head 22 could be fabricated from a suitable rigid tube having the desired diameter. Alternatively, the pick-up head 22 could be provided with a curved bottom having other than a cylindrical configuration.

Furthermore, it is not absolutely essential that a support post 32 be provided for mounting the pick-up assembly 14 or 44 on the container 12 or 42. All that is required is that the pick-up assembly 14 or 44 be positioned at a suitable angle and location by any convenient means, e.g. clamping one end of its coil spring to a top center location of one of the ends of the container 12 or 42, which both adequately secures the coil spring 28 of the pick-up assembly 14 or 44 and provides rigidity for the secured end of said coil spring 28. And, while stainless steel is the preferred material for the coil spring 28, the spring cover 30 which is provided by the present invention permits use of lesser expensive springs without significantly increasing the likelyhood of crud build-up on and between the coils of such springs.

While the present invention has been disclosed in connection with its preferred embodiments, there may be other embodiments which fall within the scope and spirit of the invention as defined by the claims.

I claim:

1. A device for simultaneously dispensing two sheets of paper or similar sheet material, comprising:

(a) an essentially rectangular container for two identical stacks of tissue paper or similar sheet material, said container having a pair of ends, a pair of sides, a bottom, and a separate compartment for each of said identical stacks of tissue paper or similar sheet material;

(b) a pick-up head having a rigid shaft connected thereto, said pick-up head being configured for simultaneously contacting the top sheet of each of said identical stacks of tissue paper or similar sheet material when pressed downward by the user of the device;

(c) a coil spring having one of its ends fitted over the free end of said rigid shaft and the other of its ends rigidly connected at a positive angle to a top center location on one of said ends of said container; and (d) a non-drying, pressure sensitive, tacky adhesive secured to said pick-up head for simultaneously contacting the top sheet of each of said identical stacks of tissue paper or similar sheet material when said pick-up head is pressed downward by the user of the device and for retaining the top sheet of each of said identical stacks of tissue paper or similar sheet material when said pick-up head is released by the user of the device.

2. A device for simultaneously dispensing two sheets of tissue paper or similar sheet material as recited in claim 1, further comprising a semi-rigid cover for said coil spring.

3. A device for simultaneously dispensing two sheets of tissue paper or similar sheet material as recited in claim 2, further comprising a drip washer on said rigid shaft between said pick-up head and said coil spring.

* * * * *

UNITED STATES PATENT AND TRADEMARK OFFICE

CERTIFICATE OF CORRECTION

PATENT NO. : 4,417,670

DATED : November 29, 1983

INVENTOR(S) : Homer L. Booher

It is certified that error appears in the above-identified patent and that said Letters Patent is hereby corrected as shown below:

In Column 4, Line 34, "drop" should read --drip--.

In Column 4, Line 42, "drop" should read --drip--.

In Column 5, Line 58, "drop" should read --drip--.

Signed and Sealed this

*Seventh* Day of *February 1984*

[SEAL]

*Attest:*

GERALD J. MOSSINGHOFF

*Attesting Officer*

*Commissioner of Patents and Trademarks*